US006612124B1

(12) United States Patent
Hatch et al.

(10) Patent No.: US 6,612,124 B1
(45) Date of Patent: Sep. 2, 2003

(54) SIMPLIFIED FOOD-PREPARATION TABLE WITH EASY ACCESSIBILITY OF TEMPERATURE-PROTECTED FOOD

(75) Inventors: Brett Hatch, Santa Clara, CA (US); Burton Hatch, Santa Clara, CA (US); True Hatch, Santa Clara, CA (US); Barlow Hatch, Santa Clara, CA (US)

(73) Assignee: T3B, Inc., a California Corporation, Santa Clara, CA (US)

( * ) Notice: Subject to any disclaimer, the term of this patent is extended or adjusted under 35 U.S.C. 154(b) by 0 days.

(21) Appl. No.: 10/143,268

(22) Filed: May 10, 2002

(51) Int. Cl.[7] ..... F25D 23/12
(52) U.S. Cl. ..... 62/258; 220/661; 220/676
(58) Field of Search ..... 62/258; 220/661, 220/676, DIG. 29

(56) References Cited

U.S. PATENT DOCUMENTS

| | | | | |
|---|---|---|---|---|
| 180,009 | A | | 7/1876 | Dann |
| 404,255 | A | | 5/1889 | Brandenburg |
| 510,798 | A | | 12/1893 | Kendall |
| 1,316,006 | A | | 9/1919 | Wagner |
| 1,636,393 | A | | 7/1927 | Theophiledes |
| 1,737,240 | A | | 11/1929 | Hois |
| 1,774,312 | A | | 8/1930 | Braeutigan |
| 3,780,794 | A | | 12/1973 | Staub |
| 4,026,274 | A | | 5/1977 | Gutierrez |
| 4,397,298 | A | | 8/1983 | Abell |
| 4,628,697 | A | * | 12/1986 | Bruck et al. ..... 62/89 |
| 4,856,579 | A | | 8/1989 | Wolfe |
| 5,097,753 | A | | 3/1992 | Naft |
| 5,131,708 | A | | 7/1992 | Denzin |
| 5,182,924 | A | * | 2/1993 | Trulaske, Sr. ..... 62/255 |
| 5,191,769 | A | * | 3/1993 | Mangini et al. ..... 62/258 |
| 5,203,257 | A | | 4/1993 | Goad |
| 5,277,039 | A | | 1/1994 | Haasis |
| 5,282,367 | A | | 2/1994 | Moore et al. |
| 5,355,687 | A | | 10/1994 | Carpenter et al. |
| 5,363,672 | A | | 11/1994 | Moore et al. |
| 5,366,107 | A | | 11/1994 | Rostkowski |
| 5,381,672 | A | | 1/1995 | Haasis |
| 5,423,194 | A | | 6/1995 | Senecal |
| 5,477,702 | A | | 12/1995 | Kennedy et al. |
| 5,676,276 | A | | 10/1997 | Zielinski et al. |
| 5,699,784 | A | | 12/1997 | Tippmann et al. |
| 5,718,124 | A | | 2/1998 | Senecal |
| 5,758,572 | A | | 6/1998 | Hennessy et al. |
| 5,762,226 | A | | 6/1998 | Baltus et al. |
| 5,778,800 | A | | 7/1998 | Liang |
| 5,900,173 | A | | 5/1999 | Robards, Jr. |
| 5,927,092 | A | | 7/1999 | Kushen et al. |
| 6,089,036 | A | | 7/2000 | Carlson et al. |
| 6,143,106 | A | | 11/2000 | Shane |
| 6,202,432 | B1 | * | 3/2001 | Haasis ..... 62/258 |
| 6,237,775 | B1 | | 5/2001 | Hatch et al. |
| 6,367,651 | B2 | | 4/2002 | Laib et al. |
| 6,385,990 | B1 | | 5/2002 | Lee |
| 2001/0019060 | A1 | | 9/2001 | Zank |

FOREIGN PATENT DOCUMENTS

| | | |
|---|---|---|
| DE | 26220 | 3/1883 |
| NL | 40258 | 10/1936 |

* cited by examiner

*Primary Examiner*—William E. Tapolcai
(74) *Attorney, Agent, or Firm*—Jansson, Shupe & Munger, Ltd.

(57) ABSTRACT

A food-preparation table includes (a) a table base (18) having a top member (20) with a top surface (16) and pan-receiving space(s) (22) beneath the top member holding thermally-useful air, and pan-supporting surfaces (14) adjacent to the space(s), and (b) pans (10) in the space(s), each pan having a sidewall (24) and an upper edge (12) and vents (30) through the upper sidewall portion (28) such that thermally-useful air flows from the space(s) into the pans to contact the food even though the table-base top member, the pan-supporting surfaces and the pan upper edges are arranged such that the pan upper edges are flush with the table-base top surface. Temperature protection for the food is provided while allowing easy accessibility for serving.

18 Claims, 4 Drawing Sheets

SIMPLIFIED FOOD-PREPARATION TABLE WITH EASY ACCESSIBILITY OF TEMPERATURE-PROTECTED FOOD

FIELD OF THE INVENTION

This invention relates generally to food-service equipment and, more particularly, to food-preparation tables of the type having a plurality of food pans on a table base with thermally-useful means for purposes of temperature maintenance.

BACKGROUND OF THE INVENTION

In the food-service industry many different kinds of establishments use food-preparation tables to present cold food for serving by food-service personnel or patrons. Food-preparation tables are large devices each of which has two major portions: (1) a table base, which is a structure with various parts (hereafter described) that is adapted to receive a plurality of food-service pans, and (2) the pans themselves, supported in their serving positions in/on the table base. When in use for serving, the pans have open tops to allow access to the food presented therein.

A typical table base of a food-preparation table has a top member with a top surface, openings (or a large unitary opening) in the top member to a pan-receiving space or spaces beneath the top member and pan-supporting surfaces adjacent to the pan-receiving space(s) for supporting the pans in such space(s) in serving positions, and a thermal device to provide thermally-useful air in the space(s) around the pans. Each pan typically has a sidewall with an upper portion terminating in an upper edge which forms the open top from which food in the pan is served.

In the food-service business, it is often necessary to leave cold food on display in pans of refrigerated food-preparation tables for extended periods of time. Current standards, such as the applicable American National Standard/NSF International Standard, require that these devices be able to hold all of the cold food product in the pans at temperatures not exceeding 41° F. Food-preparation tables of the prior art, however, have significant shortcomings and problems with respect to efforts to meet the food-service industry's requirements for proper maintenance of food temperatures.

At least three types of problems and shortcomings are experienced:

In some cases, temperature maintenance requirements are simply not met, particularly with long service periods (i.e., long periods during which food in the pans remains in place) and when air temperatures are fairly high, either because of hot weather conditions or because of the high temperatures in a kitchen. This, of course, can pose health problems and/or lead to food waste by requiring disposal sooner than might otherwise be the case. This important problem has been recognized and in some cases steps have been taken to address at least the food safety and waste issues. Such attempts, however, have led to certain other problems or shortcomings.

In certain cases, manufacturers of food-preparation tables have taken steps to recess the pans below the top surfaces of the table base (i.e., below a plane defining the majority of the top surface of the table base surrounding the pan locations) in order to provide a location on the table base, immediately above and surrounding the upper edge of the pans, for cooling coils or other thermal transfer devices. This is useful for food-protection purposes, but is widely recognized as posing difficulties on the serving process. More specifically, it is often quite difficult to reach the food that is presented in pans if their open tops are in recessed positions in the table base. This is particularly true when some depletion of the food in the pans has occurred.

This problem is experienced with respect to various kinds of food-preparation tables, including (1) those in which the top member is such that the top surface along the entire table base is generally in a single plane and (2) those in which the top member is such that the top surface has a substantially raised rear area surrounding the pan locations. Such raised rear area (or "rail") is sometimes configured with its top surface tilted toward the user; however, for either type of table base, when the pans are recessed, i.e., so that their upper edges are below the surrounding top surface (rather than having their upper edges substantially flush with the top surface), food accessibility is significantly hindered.

Indeed, because of this food-accessibility problem people often nest the food pan with and on top of other identical pans in order to raise the upper edge of the pan to facilitate serving. This, however, completely defeats the purpose for which the pan was recessed in the first place; i.e., such nesting causes the top edge to be too high to take advantage of the thermal-transfer device that had been positioned with respect to a recessed pan. Significantly, such nesting also adds harmful bottom insulation to the food pan by adding multiple metal layers and intervening dead air spaces. This combination of two disadvantages imposes food-safety risks which are greater than normal, and completely unacceptable in food-service establishments.

Another prior approach to the problem is for the table base to include an upper structure supported above the pan-surrounding top surface of the table-base top member, such structure supporting and/or including cooling apparatus above the open tops of the pans in order to cause cool air to fall or flow down onto the exposed upper surfaces of the food in the pans. (So-called "sneeze guards" are typically also supported by such upper structures.) This type of food-preparation table avoids the need for any recessing of the pans. The cooling apparatus on such structures may be cooling coils allowing the cooling of air above the pans or may be cool air outlets which are in communication with the interior of the table-base unit and allow flow of cool air to enter the pans from above the pans. While having cooling or cool-air flow apparatus above the pans can be effective for food temperature maintenance, such upper structures add considerable product complexity and considerable cost to the food-preparation table.

Still other approaches used in the prior art in an effort to allow compliance with food temperature maintenance standards are to place cooling lines (e.g., refrigerant lines) in table-base walls immediately adjacent to the pans and/or to place between the pans divider bars which have cooling lines in or around them. These approaches, however, and other measures add complexity and cost to food-preparation tables. In some prior food-preparation tables of this type there are two refrigeration units—one for cooling the space within the table base and one for the cooling lines adjacent to the pans, thus exacerbating complexity and cost of such food-preparation tables.

Cooling lines immediately adjacent to the pan walls significantly lower the temperature of the pan walls, and this can lead to unintended localized freezing of the food in the pans. This is problematic for the food, of course, but it can also cause food to stick to the pan, which is undesirable. Furthermore, when a food piece or particle sticks to the pan on or near the upper edge thereof there is a tendency to flick the food back into the pan, and this leads to contamination of the entire contents of the pan.

Food-preparation tables having table bases with refrigerant lines in close proximity to pan walls typically have the additional shortcoming of requiring frequent defrosting of the table base, an operation which demands significant personnel time. In such situations, if the table base of a food-preparation table has a drain unit, then the food-preparation table is only really suitable for an establishment that includes a floor drain, thus effectively limiting the market for such equipment. On the other hand, if the table base has no drain unit, then substantial mopping up is required during each defrosting operation.

Food temperature maintenance problems have in some cases been addressed simply by using smaller (e.g., much shallower) pans; if the pans are small enough, then the pan surfaces may succeed in maintaining the desired food temperature. However, using small pans is problematic for food-service operations because it requires frequent pan replacement and the additional scheduling burdens attendant thereto. It is highly desirable to utilize standard-size pans which hold sufficient food to minimize pan replacement at food-preparation tables.

In summary, maintaining required food temperatures in food-preparation tables remains a significant problem. The special table base structures which before this invention have been deemed necessary for that purpose have led to other problems or shortcomings, including problems related to uneven food cooling, equipment maintenance, and/or ergonomics in food-preparation table use. These problems and shortcomings are well recognized in the industry.

OBJECTS OF THE INVENTION

It is an object of the invention to provide an improved food-preparation table overcoming some of the problems and shortcomings of the prior art, including those referred to above.

Another object of the invention is to provide a food-preparation table with improved temperature-maintenance characteristics without sacrificing ease of food accessibility for the user.

Another object of the invention is to provide a food-preparation table which maintains acceptable food temperatures without risking unintended localized food freezing.

Another object of this invention is to provide a food-preparation table which allows better temperature regulation for food but avoids the problem of food being stuck to the pan.

Still another object of the invention is to provide a food-preparation table which maintains acceptable food temperatures for extended periods without excessive complexity in the table base and/or its thermal equipment.

Another related object of this invention is to provide a food-preparation table with improved temperature-maintenance characteristics without essential modification of the table base.

Another object of this invention is to provide a food-preparation table which allows improved temperature regulation for food while having only one refrigeration system (or other thermal device).

Yet another object of this invention is to provide a food-preparation table which allows better temperature regulation for food by improving air flow across the contents of the pan, and does so without modification of the table base.

Another object of the invention is to allow those in the food-service industry to comply with food quality standards while using pans of standard (or even greater) size which minimize pan replacement at food-preparation tables during food-service operations.

Another object of the invention is to allow those in the food-service industry to comply with food quality standards without ergonomic complications of the food serving process.

Another object of the invention is to allow those in the food-service industry to comply inexpensively and easily with food temperature maintenance standards.

Still another object of this invention is to provide food preparation tables that maintain food temperatures while saving on energy use.

How these and other objects are accomplished will become apparent from the descriptions which follow and from the drawings.

SUMMARY OF THE INVENTION

This invention is an improved food-preparation table of the type including a table base and a plurality of food-service pans supported in the table base in food serving positions. The food-preparation table of this invention overcomes problems and shortcomings of prior food-preparation tables, including those referred to above.

As with other food-preparation tables, the table base has a top member with a top surface, pan-receiving space(s) beneath the top member, pan-supporting surfaces adjacent to the pan-receiving space(s), and a thermal device providing thermally-useful air around the pans in the pan-receiving space(s). Each pan has a sidewall, typically made of four walls, and the sidewall includes an upper portion which terminates in an upper edge.

The improvement involves two combined characteristics: (1) the fact that the top member of the table base, the pan upper edges, and the pan-supporting surfaces are positioned and arranged such that the pan upper edges are substantially flush with the top surface; and (2) the upper portion of the sidewall of at least one (and preferably all) of the pans having at least one vent through it to allow thermally-useful air in the pan-receiving space, particularly the portion of such space adjacent to the sidewall of such pan, to flow from such space therethrough the pan sidewall and into the pan. These combined characteristics allow thermally-useful air from the pan-receiving space to come into contact with the upper surfaces of the food in the pan in order to provide temperature protection for the food, while still allowing the food to be presented in a readily accessible position for easy serving.

In preferred embodiments, the vented sidewall of the pan includes a plurality of the vents. The sidewall of each vented pan has four walls, including two opposite walls each of which has at least one of the vents, and most preferably a plurality of the vents. Most preferably, each of the four walls has at least one of the vents.

The vents are preferably each partially covered by a louver, the vent and louver being configured for downward airflow into the pan to facilitate contact with food in the pan. Preferably, the louver extends upwardly and outwardly from a bottom side of the vent. It is most preferred that the louvers be integral with the sidewall—i.e., formed with the sidewall.

The food-preparation table of this invention delivers improved temperature maintenance for food without sacrificing ease of food accessibility for the user. This is because the invention involves a way to deliver thermally-useful air to the upper surfaces of the food without recessing the pans beneath the top surface of the table-base top member. Therefore, ergonomic problems related to recessing of pans are eliminated.

In preferred embodiments, the thermal device and all heat-transfer devices thereof are beneath the top member of the table base, there being no need for any heat-transfer devices anywhere above the top surface of the table-base top member. Indeed, a flow of thermally-useful air across the top surfaces of food in the pans is provided without any modification of the table base.

As in the prior art, the pan-supporting surfaces are preferably part of the top surface of the top member. However, the pan-supporting surfaces could be different members, such as laterally extending fingers or cradling members beneath the pan bottoms or pedestal-like structures extending upward from inside the table base to engage the pan bottoms.

In certain preferred embodiments, the thermal device of the table base is a refrigeration system. Preferably the refrigeration system is a sole refrigeration system, there being no particular need for a second refrigeration system. Most preferably, all parts of the refrigeration system are beneath the top member of the table base, there being no need for cooling means of any sort above the top member. Preferably, any and all cooling coils of the refrigeration system are positioned without juxtaposition with respect to the sidewall or bottom of any pan, thereby to avoid adherence of food to pan surfaces. Because of this, acceptable temperature maintenance is provided without risking unintended localized food freezing; therefore, problems related to food being stuck to the pan are avoided.

Significantly, important food temperature maintenance for extended periods is provided without anything which in any way would make the food-preparation table complex in construction, either in the table components or in the required thermal equipment (e.g., refrigeration system). Indeed, improved temperature-maintenance characteristics are provided without any essential modification of the table base itself Furthermore, when there is no longer any need or purpose for any more than a single refrigeration system (or other thermal device) as part of the table base.

The food-preparation tables of this invention can include food pans of standard size or even larger sizes. Even when using pans of substantial depth that hold large quantities of food, the temperature-maintenance advantages of this invention are successfully delivered even during extended food-service periods. Furthermore, the provision of temperature maintenance for the upper surfaces of food has a tendency to reduce energy usage by the refrigeration device of the food-preparation table of this invention.

In short, this invention allows persons and companies in the food-service industry to comply with temperature maintenance standards for foods easily and inexpensively.

DETAILED DESCRIPTION OF PREFERRED EMBODIMENTS

Figure 5:
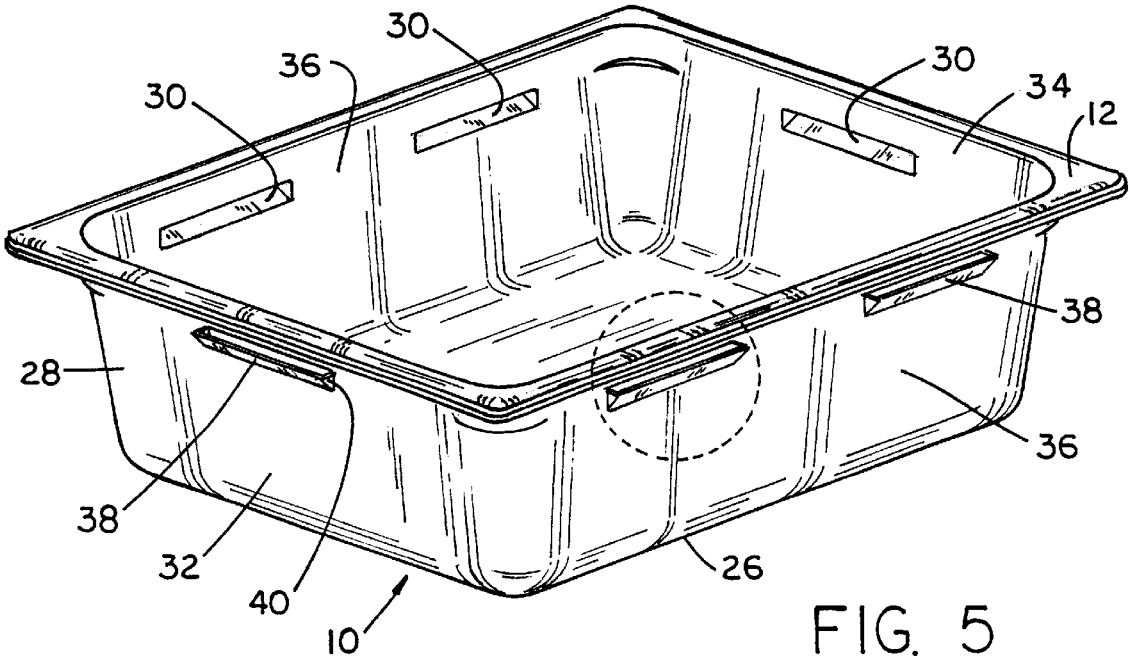
FIG. 5 is an enlarged perspective view of one of the pans of the food-preparation table of FIG. 1.
Figure 6:
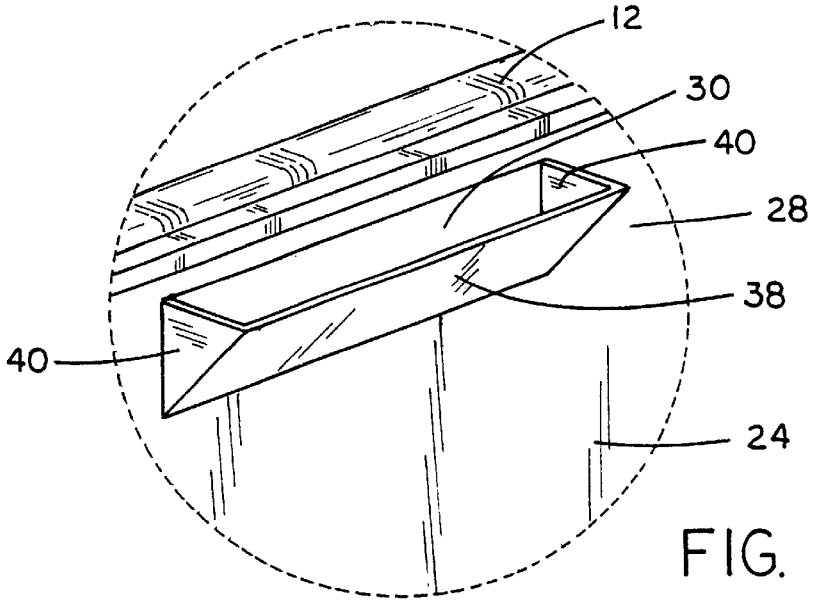
FIG. 6 is a further-enlarged perspective view showing one of the louvered vents of the pan of FIG. 5.

An understanding of the invention is aided by having a good understanding of certain of prior food-preparation tables; therefore, before referring to the drawing which illustrate preferred embodiments of the invention, FIGS. 2, 3 and 5 which depict certain prior devices discussed above will be described. These prior devices have certain characteristics intended to address the problems of food temperature maintenance, but also have significant shortcomings or problems.

Figure 2:
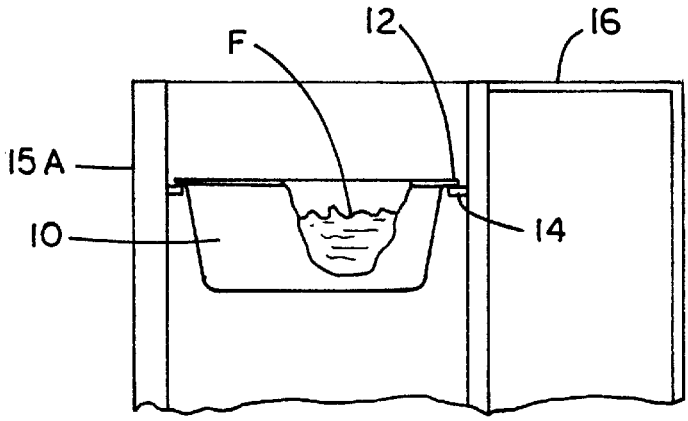
FIG. 2 PRIOR ART
FIGS. 2–4 are fragmentary schematic side sectional views of three different examples of food preparation tables of the prior art.
Figure 3:
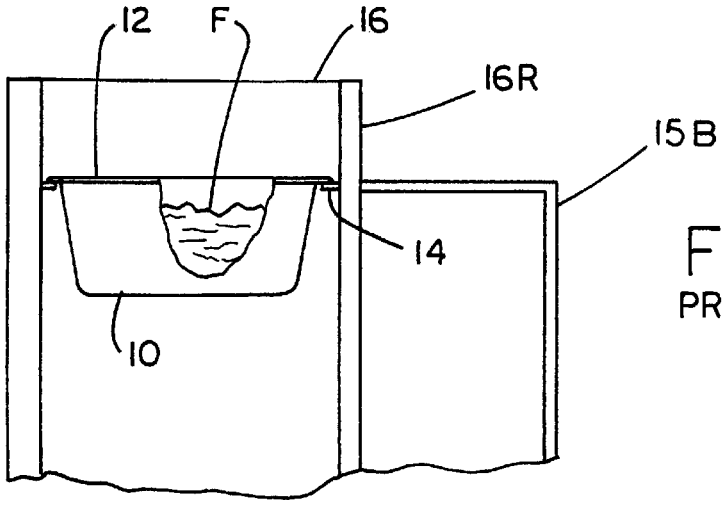
FIG. 3 PRIOR ART

FIGS. 2 and 3 show food-preparation tables having their pans 10 held in recessed positions with respect to the top surfaces 16 of their table bases 15A and 15B. The pans, of course, are supported by recessed pan-supporting surfaces 14, and by virtue of such pan recessing provide sources of cool air above the pans—in the walls surrounding the open tops of the pans. The food preparation table of FIG. 3 differs from the food-preparation table of FIG. 2 only in that it is of the type having a raised rail 16R. In each case, the recessing is for the purpose of allowing a source of cool air above pans 10.

Figure 4:
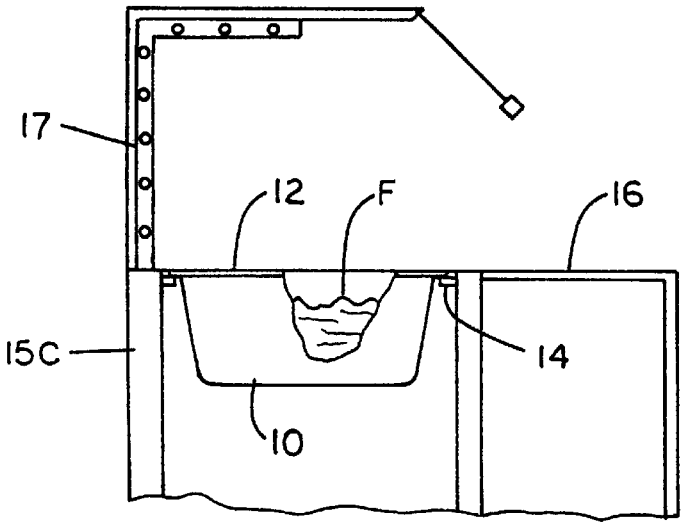
FIG. 4 PRIOR ART

FIG. 4 illustrates a prior food-preparation table having a table base 15C that includes a structure 17 positioned above the top surface 16 in order to support cooling apparatus above pan 10. Such structures are complex and also can sometimes require multiple refrigeration units.

FIGS. 1 and 5–7 illustrate a new food-preparation table in accordance with this invention. As in the prior art, the table includes a table base 18 and a plurality of pans 10. Table base 18 has a top member 20 with top surface 16. Top member 20 has pan-receiving openings 22A which are sized to receive pans 10. The portions of top surface 16 immediately along openings 22A are pan-supporting surfaces 14 which engage the pan upper edges 12. Beneath top member 20 are pan-receiving spaces 22; actually, in the embodiment illustrated each pan 10 is within a common pan-receiving space 22.

Pans may have a variety of shapes, but each pan 10 of the embodiment shown in the drawings has a pan sidewall 24 and a bottom 26. Sidewall 24 is of generally rectangular cross-section and has four walls, front and rear walls 32 and 34 which form one pair of opposite walls, and two lateral walls 36 which form another pair of opposite walls. Sidewall 24 (i.e., each of the four walls) has a sidewall upper portion 28 which terminates upwardly in pan upper edge 12. Each pan 10 has vents 30 through its sidewall upper portion 28, including through each of the four walls of sidewall 24. Vents 20 are closely adjacent to pan upper edge 12.

Top member 20 of table base 18, pan upper edges 12 and pan-supporting surfaces 14 are positioned and arranged such that pan upper edges 12 are substantially flush with top surface 16 of table base 18 when pans 10 are placed in pan-receiving openings 22A of top member 20. When in place in/on table base 18, each pan 10 is supported with its sidewall 24 and bottom 26 extending downward into pan-receiving space 22. Alternative approaches (not shown) to supporting pans 10 in the desired positions, with their upper edges 12 substantially flush with top surface 16, include various pan-supporting surfaces (ledges, fingers, pedestal, etc.) positioned below top surface 16.

Front wall 32 and rear wall 34 each have two vents 30, and each lateral walls 36 has a single vent 30. The number of vents can vary, as can the length and height of the vent openings. The vents can be of a variety of shapes and configurations, and need not be in the form illustrated in the drawings.

As seen in FIGS. 5–8, each vent has a louver 38 which is formed as part of sidewall 24. Each louver 38 extends outward and upward from the bottom edge of its corresponding vent 30. In order to prevent spillage of contents of pan 10 and in order to strengthen louver 38, a connecting louver-wall 40 joins louver 38 to pan sidewall 24 on each end of louver 38. Pans 10 are preferably made of steel, and louver-walls 40 and as well as louver 38 are preferably integrally formed with pan sidewall 24, using normal metal-working techniques.

Figure 1:
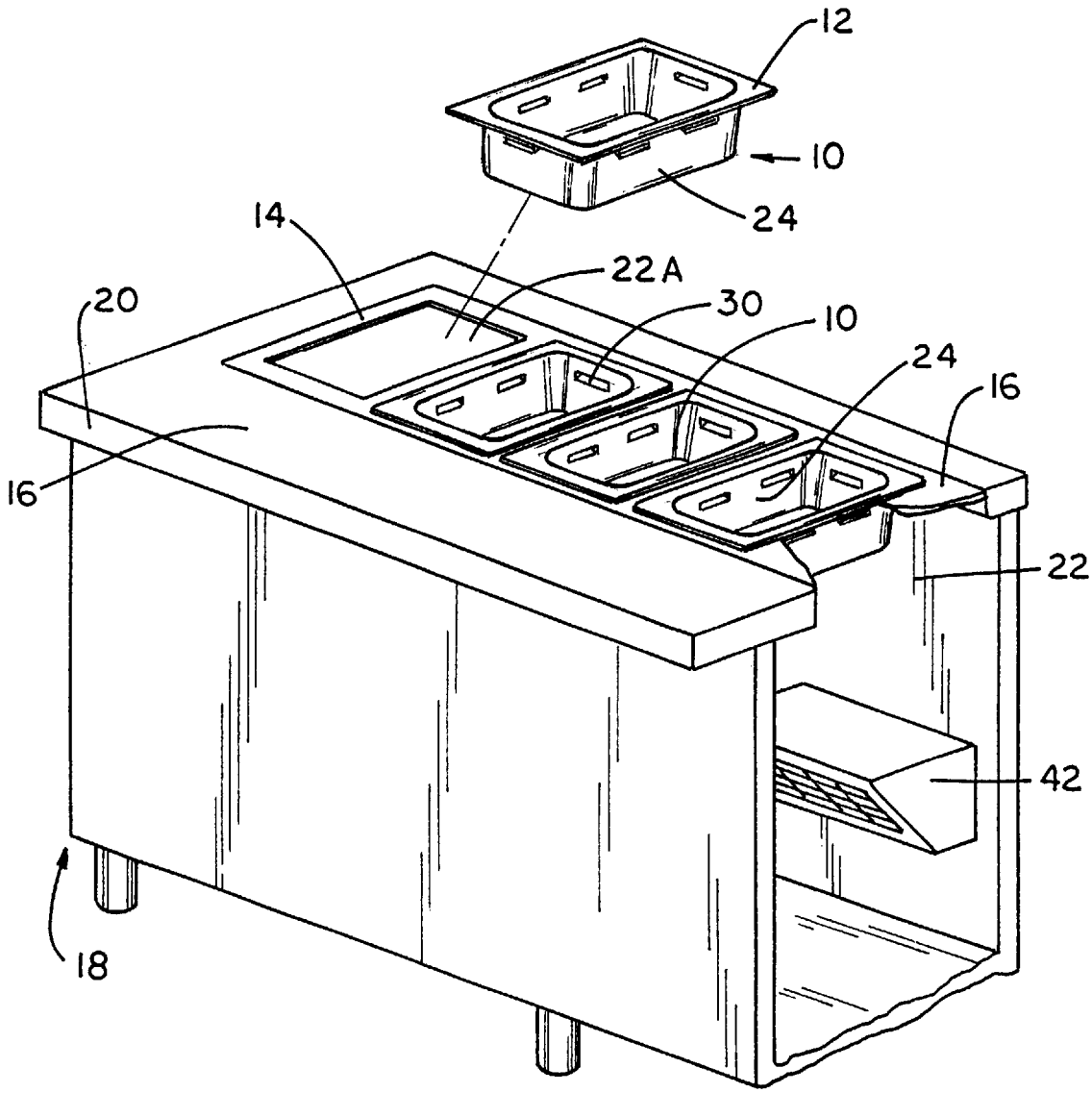
FIG. 1 is a partially cutaway, partially exploded perspective view of a food-preparation table in accordance with this invention, including the table base and some of its pans.

As shown in FIG. 1, table base 18 also has a refrigeration unit 42 located beneath top member 20 in position to supply cold air to pan-receiving space 22. Refrigeration unit 42 is the sole refrigeration unit for the food preparation table, and it serves to maintain desired food temperature in two ways: first, by conduction as in prior food preparation tables; and second, by convection to the portion of the food most exposed to harmful hot air in a kitchen or otherwise.

More specifically, the cold air in pan-receiving space 22 serves to cool the outer surfaces of pans 10 and thus cool the food in pans 10 by virtue of thermal conduction through sidewall 24, pan bottom 26 and the food itself. And, in addition to allowing this standard cooling method, the food preparation table of this invention allows cold air to flow-.from pan-receiving space 22 through vents 30 into pans 10 at positions above the food in pans 10. As illustrated by air-flow arrows in FIGS. 7 and 8, this cold air flow is over and onto the upper surfaces F of food in pans 10, the portion of the food which would otherwise be in full contact with hot or warm kitchen or ambient air. This cold air flow nestles on and over upper food surfaces F and thermally shields the food from harmful warming conditions.

The protective thermal blanket provided by the food preparation table of this invention not only protects upper food surfaces F, it tends to lessen the thermal load which otherwise would be carried by the thermal conduction that occurs through sidewall 24, pan bottom 26 and the food itself. The invention tends to completely envelop the pan and the food with thermally-useful air. The combined cooling functions of the food preparation table of this invention not only provides greater food safety, but can tend to lessen total energy usage.

Figure 7:
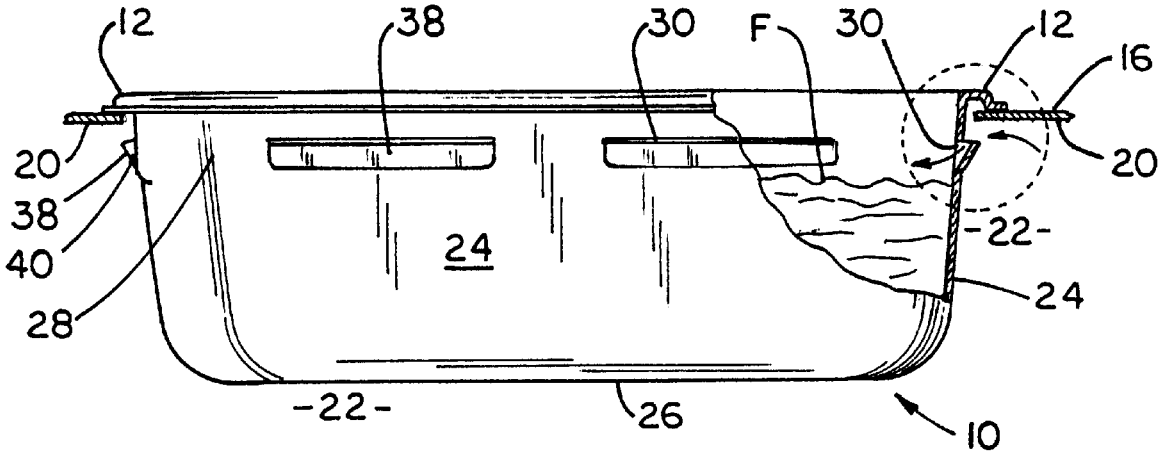
FIG. 7 is a partially cutaway, partially sectional, fragmentary front elevation of FIG. 1, showing the relationship of the pan to the table base in which it is mounted.
Figure 8:
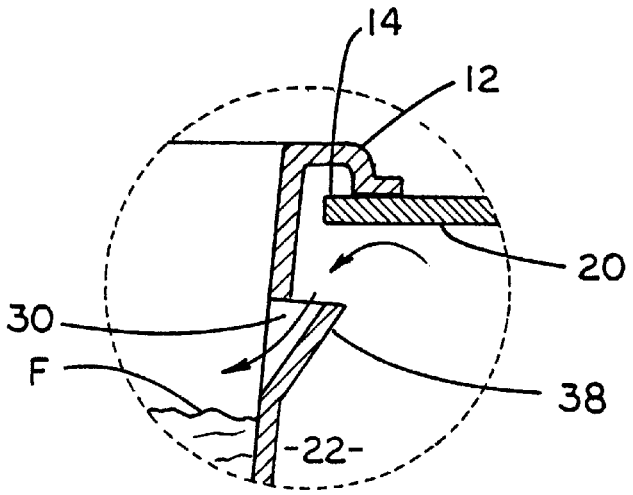
FIG. 8 is a further-enlarged detail view of a portion of FIG. 7.

As seen best in FIGS. 7 and 8, the close positioning of vents 30 and their corresponding upwardly/outwardly angled louvers 38 with respect to the undersurface of top member 20 tends to facilitate flow of cold air into pans 10 in a downward direction onto upper food surfaces F. While louvered vents are preferred and louvers of the illustrated configuration are most preferred, vents can be of other configurations and louvers, if any, can be of other configurations.

The principles of the food preparation table of this invention can be applied in a variety of situations. For example, not only can they be applied to flat-topped food preparation tables like that illustrated in FIG. 1, they can be used in a food preparation table of the type having a raised rail.

While the principles of the invention have been shown and described in connection with specific embodiments, it is to be understood that such embodiments are by way of example and are not limiting.

What is claimed is:

1. In a food-preparation table including (a) a table base having a top member with a top surface and pan-receiving space(s) beneath the top member, pan-supporting surfaces adjacent to the space(s), and a thermal device providing thermally-useful air in the space(s), and (b) pans in the space(s), each pan being uncovered for food serving and having a sidewall with an upper portion terminating in an upper edge, the improvement wherein:

the top member, the pan upper edges, and the pan-supporting surfaces are positioned and arranged such that the pan upper edges are substantially flush with the top surface; and the sidewall upper portion of at least one of the pans has at least one inflow vent through it such that thermally-useful air in the space(s) flows unrestricted there-through into the uncovered pan, thereby to provide temperature protection for the upper surfaces of food presented in a readily accessible position.

2. The food-preparation table of claim 1 including a plurality of the vents.

3. The food-preparation table of claim 2 wherein the sidewall of each of the vented pans has four walls, including two opposite walls each of which has at least one of the vents.

4. The food-preparation table of claim 3 wherein each of the four walls has at least one of the vents.

5. The food-preparation table of claim 1 wherein the thermal device of the table base is a refrigeration system.

6. The food-preparation table of claim 5 wherein the refrigeration system is a sole refrigeration system.

7. The food-preparation table of claim 6 wherein the refrigeration system and all parts thereof are beneath the top member of the table base.

8. The food-preparation table of claim 7 wherein:

each pan has a pan bottom; and the refrigeration system includes cooling coils all of which are positioned without juxtaposition with respect to the pan bottom or sidewall of any pan, thereby to avoid adherence of food to pan surfaces.

9. The food-preparation table of claim 1 wherein the thermal device includes heat-transfer devices all of which are beneath the top member of the table base.

10. The food-preparation table of claim 9 including a plurality of the vents.

11. The food-preparation table of claim 10 wherein the sidewall of each of the vented pans has four walls, including two opposite walls each of which has a plurality of the vents.

12. The food-preparation table of claim 1 wherein the pan-supporting surfaces are part of the top surface.

13. In a food-preparation table including (a) a table base having a top member with a top surface and pan-receiving space(s) beneath the top member, pan-supporting surfaces adjacent to the space(s), and a thermal device providing thermally-useful air in the space(s), and (b) pans in the space(s), each pan having a sidewall with an upper portion terminating in an upper edge, the improvement wherein:

the top member, the pan upper edges, and the pan-supporting surfaces ate positioned and arranged such that the pan upper edges are substantially flush with the top surface; and the sidewall of at least one of the pans has four walls, including two opposite walls, wherein the upper portion of each opposite wall has at least one vent through it, each vent being partially covered by a louver and the vent and louver being configured such that thermally-useful air in the space(s) flows theretrough and downward into the pan to facilitate contact with food in the pan, thereby to provide temperature protection for the upper surfaces of food presented in a readily accessible position.

14. The food-preparation table of claim 13 wherein the louver extends upwardly and outwardly from a bottom side of the vent.

15. The food-preparation table of claim 13 wherein the louver is integral with the sidewall.

16. In a food-preparation table including (a) a table base having a top member with a top surface and pan-receiving space(s) beneath the top member, pan-supporting surfaces adjacent to the space(s), and a thermal device providing thermally-useful air in the space(s), wherein the thermal device includes heat-transfer devices all of which are beneath the top member of the table base, and (b) pans in the space(s), each pan having a sidewall with an upper portion terminating in an upper edge, the improvement wherein:

the top member, the pan upper edges, and the pan-supporting surfaces are positioned and arranged such that the pan upper edges are substantially flush with the top surface; and the sidewall of at least one of the pans has four walls, including two opposite walls, wherein the upper portion of each opposite wall has a plurality of vents through it, each vent being partially covered by a louver and the vent and louver being configured such that thermally-useful air in the space(s) flows therethrough and downward into the pan to facilitate contact with food in the pan, thereby to provide temperature protection for the upper surfaces of food presented in a readily accessible position.

17. The food-preparation table of claim 16 wherein the louver extends upwardly and outwardly from a bottom side of the vent.

18. The food-preparation table of claim 16 wherein the louver is integral with the sidewall.

* * * * *